US010506864B2

(12) United States Patent
Sasaki

(10) Patent No.: US 10,506,864 B2
(45) Date of Patent: Dec. 17, 2019

(54) STICK-SHAPED COSMETIC MATERIAL DISPENSING CONTAINER

(71) Applicant: TOKIWA CORPORATION, Nakatsugawa-shi, Gifu (JP)

(72) Inventor: Arata Sasaki, Kawaguchi (JP)

(73) Assignee: TOKIWA CORPORATION, Nakatsugawa-shi, Gifu (JP)

( * ) Notice: Subject to any disclaimer, the term of this patent is extended or adjusted under 35 U.S.C. 154(b) by 0 days.

(21) Appl. No.: 15/957,920

(22) Filed: Apr. 20, 2018

(65) Prior Publication Data

US 2018/0303219 A1 Oct. 25, 2018

(30) Foreign Application Priority Data

Apr. 20, 2017 (JP) ..... 2017-083739
Jun. 19, 2017 (JP) ..... 2017-119834

(51) Int. Cl.

| | |
|---|---|
| ***A45D 40/06*** | (2006.01) |
| ***A45D 40/20*** | (2006.01) |
| ***A46B 9/02*** | (2006.01) |
| *A45D 34/00* | (2006.01) |
| *A45D 40/00* | (2006.01) |

(52) U.S. Cl.

CPC ..... *A45D 40/205* (2013.01); *A45D 40/06* (2013.01); *A45D 40/065* (2013.01); *A46B 9/021* (2013.01); *A45D 2034/007* (2013.01); *A45D 2040/0012* (2013.01); *A45D 2040/201* (2013.01); *A45D 2040/208* (2013.01); *A46B 2200/1046* (2013.01)

(58) Field of Classification Search

CPC ..... A45D 2040/0062
USPC ..... 401/58, 87, 92, 93, 94
See application file for complete search history.

(56) References Cited

U.S. PATENT DOCUMENTS

2009/0123213 A1* 5/2009 Tani ..... A45D 40/04 401/75

FOREIGN PATENT DOCUMENTS

JP 2001-218621 8/2001

* cited by examiner

*Primary Examiner* — David J Walczak
*Assistant Examiner* — Joshua R Wiljanen
(74) *Attorney, Agent, or Firm* — Soei Patent & Law Firm

(57) ABSTRACT

A stick-shaped cosmetic material appears or disappears from a front end of the tip cylinder along with the advance or retract of the moving body, a concave portion extends to a holding portion on an inner peripheral surface of the tip cylinder, a convex portion held by the concave portion is formed on an outer peripheral surface of the stick-shaped cosmetic material, the shape of the stick-shaped cosmetic material when viewed from the front side is formed so as to be tapered as being separated from an opposing portion to the holding portion, and a width of the opposing portion of the stick-shaped cosmetic material when viewed from the front side is substantially the same as a width of the holding portion when viewed from the front side.

20 Claims, 12 Drawing Sheets

STICK-SHAPED COSMETIC MATERIAL DISPENSING CONTAINER

CROSS-REFERENCE TO RELATED APPLICATION

This application is based upon and claims the benefit of priority from Japanese Patent Applications No. 2017-083739, filed on Apr. 20, 2017, and No. 2017-119834, filed on Jun. 19, 2017, the entire contents of which are incorporated herein by reference.

BACKGROUND

Field

The present disclosure relates to a stick-shaped cosmetic material dispensing container which dispenses a stick-shaped cosmetic material.

Related Art

As a stick-shaped cosmetic material dispensing container of the related art, a container described in Japanese Unexamined Patent Publication No. 2001-218621 has been known. Japanese Unexamined Patent Publication No. 2001-218621 describes a stick-shaped cosmetic material dispensing container which includes a tip cylinder accommodating a stick-shaped cosmetic material; and a container main body fitted rotatably to the tip cylinder. In the stick-shaped cosmetic material dispensing container, the stick-shaped cosmetic material appears or disappears from a notch formed in the tip cylinder because the container main body rotates relative to the tip cylinder.

The notch in the tip cylinder is formed to extend backward from the front end of the tip cylinder so that the stick-shaped cosmetic material is held by a front end portion positioned on an opposite side of the notch in the radial direction, that is to say the notch is formed at a tip end (i.e. the "front end") of the tip cylinder, and the front end portion is aligned with the notch (i.e. at the "opposite side" of the notch in the radial direction). Further, the stick-shaped cosmetic material is exposed from the notch of the tip cylinder when the cosmetic material is facing or aligned with the front end portion of the tip cylinder. When the stick-shaped cosmetic material does not project beyond the tip cylinder, a portion of the stick-shaped cosmetic material that is exposed at the notch can be used. By using the portion of the stick-shaped cosmetic material that is exposed at the notch, as described above, stabilized utilization of the stick-shaped cosmetic material has been attempted.

SUMMARY

In the above-described stick-shaped cosmetic material dispensing container, the stick-shaped cosmetic material is exposed from the notch of the tip cylinder. Accordingly, when a force is applied to the stick-shaped cosmetic material against the above-described front end portion side, since the stick-shaped cosmetic material is held by the front end portion, the stick-shaped cosmetic material can be stably used. However, when a force is applied to the stick-shaped cosmetic material in a direction other than the front end portion side, there is a risk that the stick-shaped cosmetic material is shaken and/or broken.

Further, in the above-described stick-shaped cosmetic material dispensing container, the front end portion is disposed to surround the outer periphery of the stick-shaped cosmetic material in the circumferential direction. Accordingly, the front end portion, together with the stick-shaped cosmetic material, may enter the field of vision of a user of the stick-shaped cosmetic material dispensing container (i.e. blocks the view) when the user applies make-up using the stick-shaped cosmetic material. Since the front end portion becomes a visual obstacle, it may be difficult for the user to see a surface (e.g. skin, etc.) where it is desired to apply the make-up and/or to see the make-up as it is being applied onto the surface. As described above, the front end portion of the tip cylinder may enter the field of vision when a user applies the make-up. Accordingly, the stick-shaped cosmetic material dispensing container of the related art may be inconvenient for a user to use, and there is a need to improve usability.

Accordingly, a stick-shaped cosmetic material dispensing container as will be described herein helps reduce breakage of a stick-shaped cosmetic material for improved usability.

According to one or more embodiments, there is provided a stick-shaped cosmetic material dispensing container including: a cylindrical container including a container front portion and a container rear portion; a moving body having a male screw member; and a female screw member. In the cylindrical container, the container rear portion is mounted on the container front portion to be rotatable around an axis line and immovable in an axial direction. The moving body is movable in the axial direction with respect to the container front portion, holds a stick-shaped cosmetic material with a front end thereof, and includes a male screw on an outer periphery thereof. The female screw member which is not rotatable around the axis line with respect to the container rear portion, includes a female screw that is threadedly engaged with the male screw on an inner periphery thereof. A thread-engagement action of a thread portion fainted of the male screw and the female screw works due to a relative rotation of the container front portion and the container rear portion so that the moving body advances and retracts, and the stick-shaped cosmetic material appears or disappears from a front end of the container front portion along with the advance or retract of the moving body. The container front portion includes a holding portion which is notched backward from the front end thereof and holds the stick-shaped cosmetic material. The stick-shaped cosmetic material has a contact portion (comprising "opposing portions") that faces and engages with the holding portion. The stick-shaped cosmetic material also has an application portion that is opposite the contact portion and that is configured to be exposed at the notched side of the holding portion, for applying the make-up. The holding portion is shaped so as to be tapered toward a front side thereof. One of a concave portion and a convex portion extending in the axial direction extends to the holding portion on an inner peripheral surface of the container front portion. The other of the concave portion or the convex portion (i.e. contact portion of the cosmetic stick) which extends in the axial direction and is held by the one (i.e. by the concave or convex portion of the holding portion). The contact portion is need on an outer peripheral surface of the stick-shaped cosmetic material and comprises a shape that is complementary (i.e. inversely shaped) to a surface of the holding portion. When viewed from the front side (i.e. from the tip end), the stick-shaped cosmetic material is formed so as to be tapered as being separated from an opposing portion to the holding portion (i.e. from the contact portion), that is to say, the width of the stick-shaped cosmetic material diminishes as the distance from the contact portion increases, so as to be tapered from the contact portion toward the application portion. In addition, when viewed from the front side (i.e. from the tip end), a width of the contact portion of the stick-shaped cosmetic material is substantially the same as a width of the holding portion.

According to one or more embodiments of the stick-shaped cosmetic material dispensing container, the container front portion includes the holding portion that holds the stick-shaped cosmetic material, and one of the concave portion and the convex portion extending in the axial direction extends to the holding portion. Further, the other (i.e. the contact portion of the cosmetic stick) of the concave portion or the convex portion extending in the axial direction and being held by the one (the concave portion or the convex portion of the holding portion) is formed on the outer peripheral surface of the stick-shaped cosmetic material. Accordingly, since one of the concave portion and the convex portion of the holding portion holds the other of the concave portion or the convex portion of the stick-shaped cosmetic material, the stick-shaped cosmetic material can be rigidly held by the holding portion by the convex portion being held by the concave portion. Therefore, shaking of the stick-shaped cosmetic material can be reduced and thus breakage of the stick-shaped cosmetic material can be prevented because the stick-shaped cosmetic material can be more rigidly held by the concave portion holding the convex portion even when a force is applied to the stick-shaped cosmetic material from almost any direction. Further, the shape of the stick-shaped cosmetic material when viewed from the front side is formed so as to be tapered as being separated from the opposing portion to the holding portion, that is to say, when viewed from the tip end (i.e. the front side), the stick-shaped cosmetic material is tapered from the contact portion toward the application portion. The width of the contact portion of the stick-shaped cosmetic material when viewed from the front side is substantially the same as the width of the holding portion when viewed from the front side. By setting the width of the holding portion to be substantially the same as the width of the stick-shaped cosmetic material, it is possible to minimize any visual obstruction when applying the cosmetic material (i.e. applying the make-up). Accordingly, since the holding portion minimizes the visual obstruction of the field of vision, the user can more easily view where to apply the make-up. Therefore, the usability can be improved.

Further, the concave portion which extends in the axial direction is formed on the inner peripheral surface of the container front portion, the convex portion which extends in the axial direction and is held by the concave portion is formed on the outer peripheral surface of the stick-shaped cosmetic material, and a width of a portion of the convex portion entering the concave portion when viewed from the front side may be greater than a width of an opening portion of the concave portion when viewed from the front side. Here, when a force is applied to the stick-shaped cosmetic material in a direction such that the stick-shaped cosmetic material tends to be detached from the concave portion, the outside surface of the convex portion is pressed against the inside surface of the concave portion, and thus detachment of the convex portion from the concave portion and breakage can be reliably reduced. In other words, since the resistance of the stick-shaped cosmetic material to the force applied in a direction that tends to cause the convex portion to detach from the concave portion can be improved, the breakage of the stick-shaped cosmetic material can be more reliably reduced.

According to one or more embodiments, it is possible to prevent breakage of the stick-shaped cosmetic material and improve the usability.

DESCRIPTION OF THE EMBODIMENTS

Figure 1:
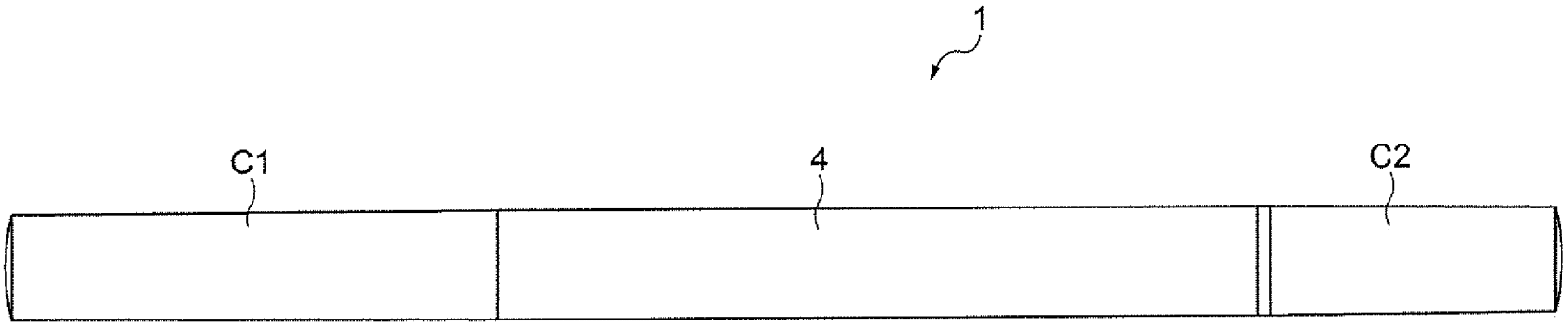
FIG. 1 is a side view of a stick-shaped cosmetic material dispensing container according to a first group of embodiments.

Hereinafter, embodiments of a stick-shaped cosmetic material dispensing container will be described in detail with reference to the accompanying drawings. In the description of the drawings, the same or corresponding elements are denoted by the same reference numerals and the description thereof will not be repeated.

First Group of Embodiments

Figure 2:
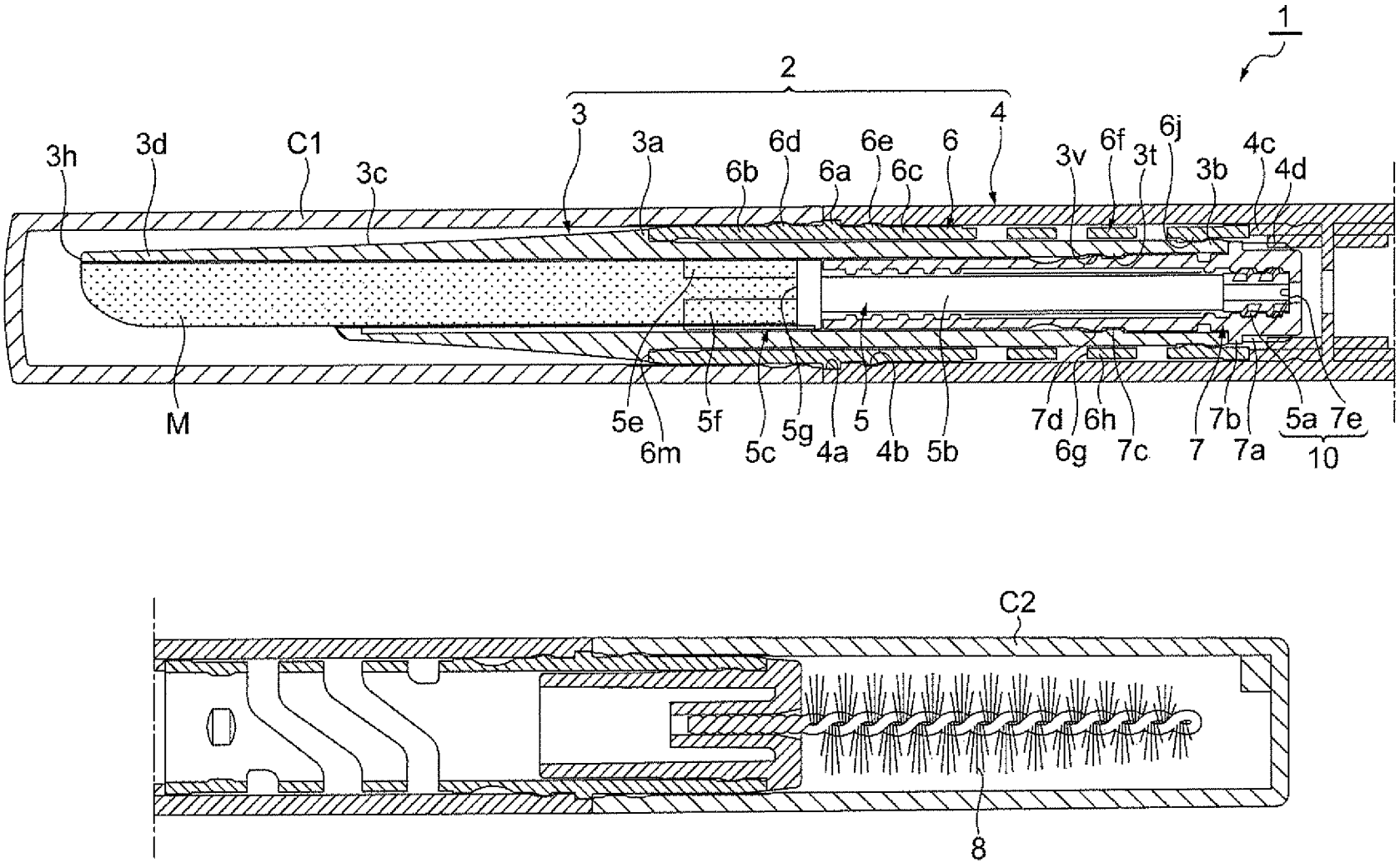
FIG. 2 is a longitudinal sectional view illustrating the stick-shaped cosmetic material dispensing container of FIG. 1.

As illustrated in FIGS. 1 and 2, a stick-shaped cosmetic material dispensing container 1 (also referred to herein as "cosmetic dispensing container" or "container") according to a first embodiment has a shape of a thin elongated cylindrical stick, for example, a writing instrument, as an overall shape. Further, the cosmetic dispensing container contains a stick-shaped cosmetic material M (also referred to herein as a "cosmetic stick M") covered by a cap C1. In the cosmetic dispensing container 1, a user can apply make-up using the cosmetic stick M immediately when the cap C1 is removed. As an example, the cosmetic stick M comprises eyebrow make-up and the cosmetic dispensing container 1 is an eyebrow make-up dispensing container.

For example, the cosmetic dispensing container 1 includes a cylindrical container 2 that includes a tip cylinder 3 that constitutes a container front portion or a dispensing portion and a container main body 4 constituting a container rear portion; a moving body 5 that is accommodated in the tip cylinder 3; a spring member 6 that is accommodated in the container main body 4; a female screw member 7 that is accommodated in the spring member 6; a blush portion 8 that is provided on the rear side of the container main body 4; and a cap C2 that covers the brush portion 8 and is provided detachably from the container main body 4.

In the present specification, the "axis" or "axis line" indicates a line extending between a rear end and a front end of the cosmetic dispensing container 1, and may extend at a center of the cosmetic dispensing container 1, according to one or more embodiments. The "axial direction" indicates a front-rear direction or orientation along the axis or axis line. Further, the direction of dispensing the cosmetic stick M is set as forward (advancing direction) and the direction of retreating the cosmetic stick M is set as backward (retracting direction).

Figure 3A:
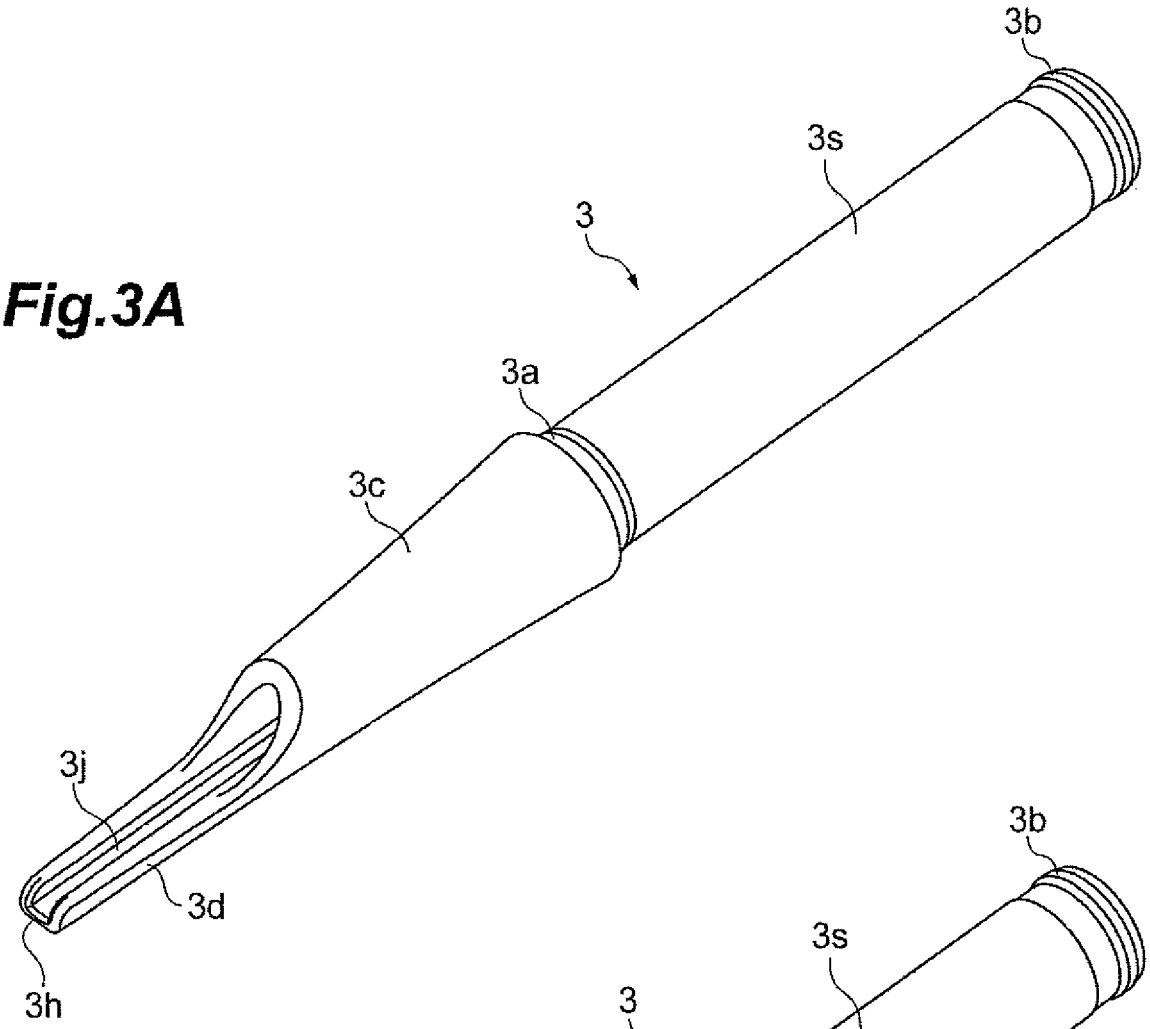
FIGS. 3A and 3B are perspective views illustrating a tip cylinder of the stick-shaped cosmetic material dispensing container of FIG. 1.
Figure 3B:
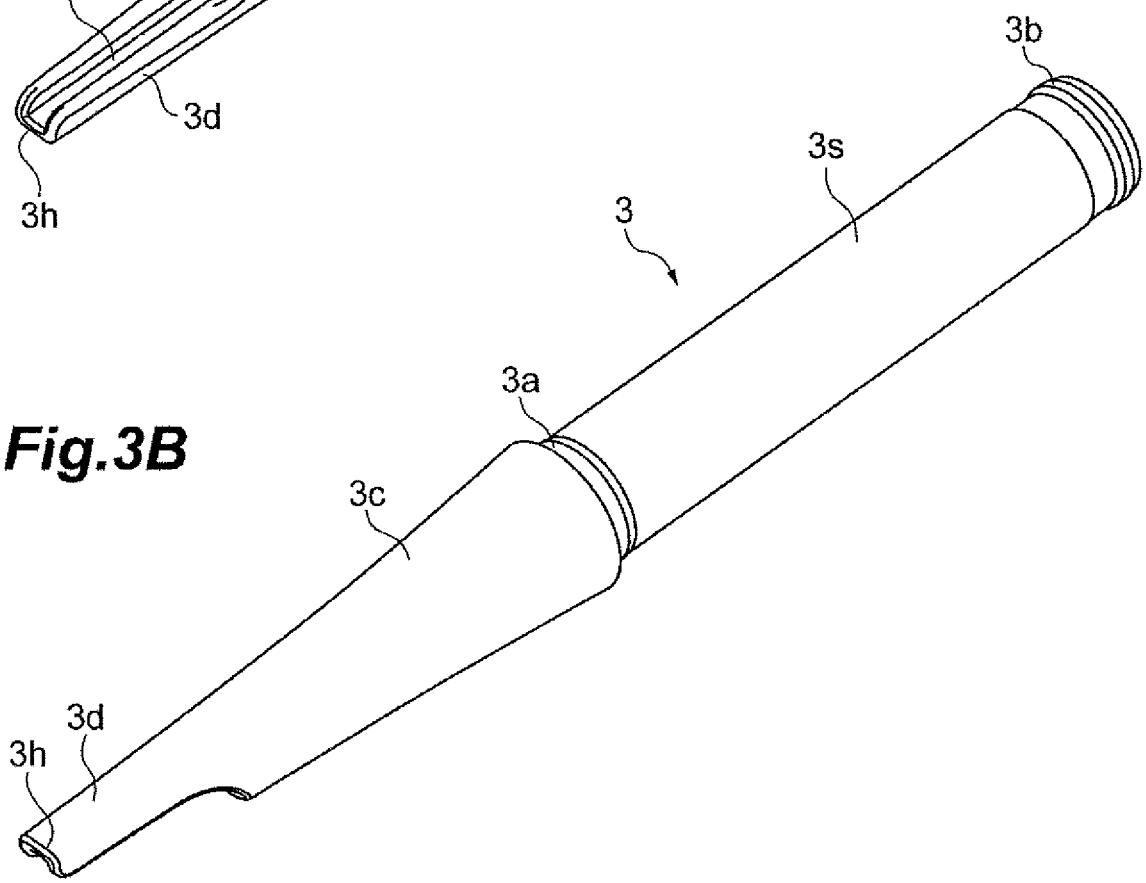

As illustrated in FIGS. 3A and 3B, the tip cylinder 3 is formed to have a thin elongated round stick shape as a whole. The tip cylinder 3 is formed in a stepped cylindrical shape provided with a stepped portion 3*a* whose diameter increases toward the front side (i.e. toward a tip end) on the outer peripheral surface in the vicinity of the center in the axial direction. A portion on the rear side (i.e. toward a connecting end) from the stepped portion 3*a* is formed as a cylindrical portion 3*s* (also referred to as a "rear portion 3*s*" or "connecting portion 3*s*"). A portion on the front side from the stepped portion 3*a* is formed as an inclined surface 3*c* (also referred to as a "front portion 3*c*" or "application portion 3*c*") which has a diameter that decreases toward the front side (i.e. toward the tip end) on the outer peripheral surface of the tip cylinder 3.

A support, for example a holding portion 3*d*, that holds or supports the cosmetic stick M is provided on the front side of the tip cylinder 3 from the inclined surface 3*c*, projecting along the axis of the main body. The shape of the holding portion 3*d* is formed such that a side surface of the tip cylinder 3 is notched. A notch line (i.e. a contour or outline of the notched area of the tip cylinder) forms an outlet of the tip cylinder 3. In the holding portion 3*d*, one side surface of the tip cylinder 3 is notched and the holding portion extends to the rear side from a front end 3*h* of the tip cylinder 3. The holding portion 3*d* (also referred to herein as "support" or "holding member") comprises a profiled guide in order to engage a profiled contact surface of the cosmetic stick M. The profiled guide may include a concave portion (having U-shaped cross-section) or a convex portion (having a T-shaped cross-section), for example. The holding portion 3*d* will be described in detail further below.

The connecting portion 3*s* of the tip cylinder 3 is cylindrical and inserted into the spring member 6 having a cylindrical shape. The application portion 3*c* is exposed to the outside, that is to say the application portion 3*c* projects out from the main body 4. An uneven annular portion 3*b* engaged with the spring member 6 rotatably and immovably in the axial direction, is formed on the outer peripheral surface of the tip cylinder 3 on the rear side. That is to say, the annular portion 3*b* is coupled with the spring member 6 to allow rotation relative to the spring member 6 while blocking movement in the axial direction relative to the spring member 6.

Figure 4:
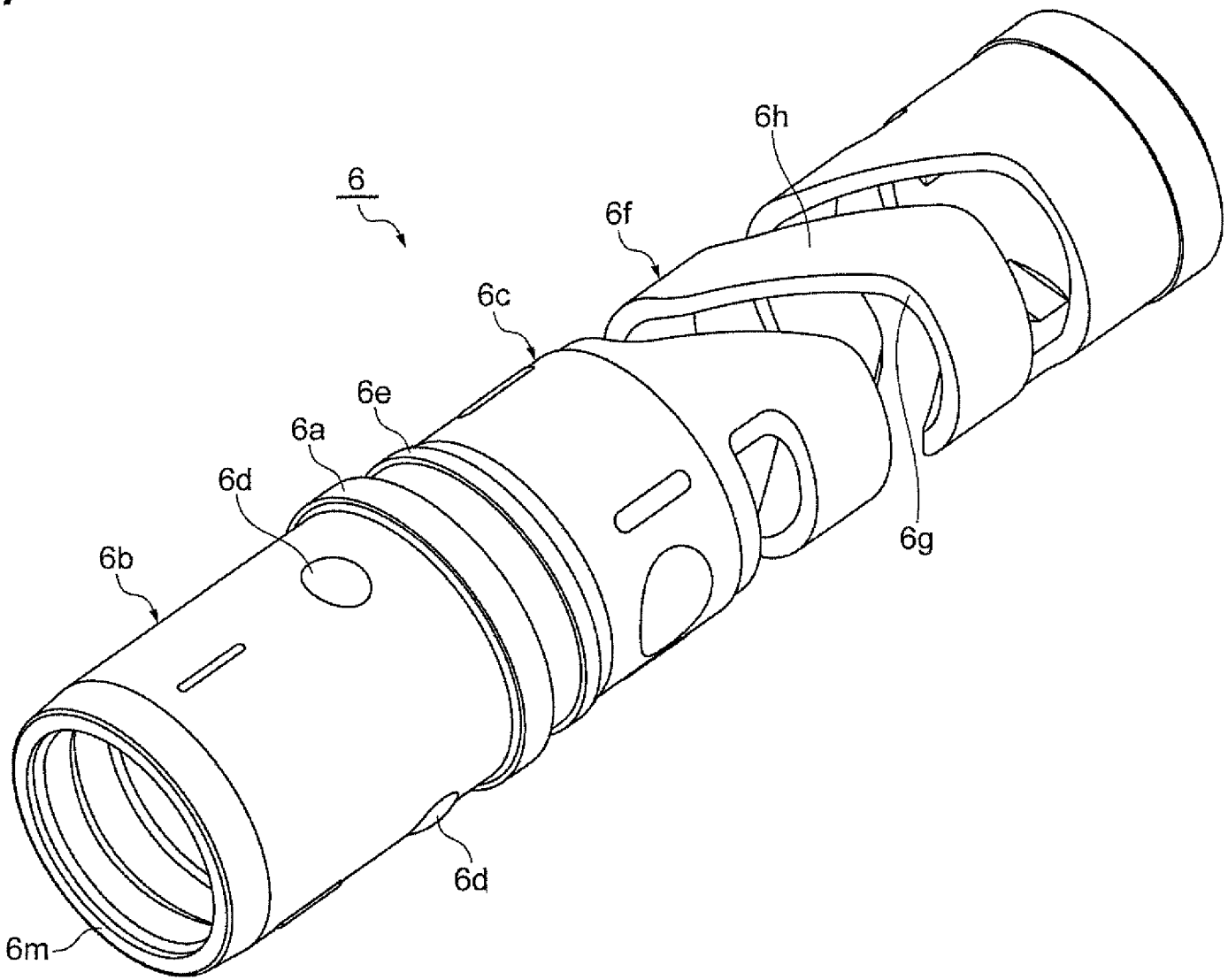
FIG. 4 is a perspective view illustrating a spring member of the stick-shaped cosmetic material dispensing container of FIG. 1.

As illustrated in FIGS. 2 and 4, the spring member 6 is formed to be substantially cylindrical. An annular convex portion 6*j* engaged with the uneven annular portion 3*b* of the tip cylinder 3 in the axial direction is formed on the inner peripheral surface of the spring member 6 on the rear side. The spring member 6 has a function of alleviating the impact on the inside of the cosmetic dispensing container 1 and protecting the cosmetic dispensing container 1 against an action of an external force, for example if the cosmetic dispensing contain 1 is dropped, shaken, or hit against a hard surface.

A front end 6*m* of the spring member 6 is brought into contact with the stepped portion 3*a* of the tip cylinder 3 from the rear side thereof. The spring member 6 includes: a flange portion 6*a* provided on the front side in the axial direction thereof; a front-side cylindrical portion 6*b* positioned on the front side of the flange portion 6*a*; and a rear-side cylindrical portion 6*c* positioned on the rear side of the flange portion 6*a*. A hemispherical protrusion 6*d* for mounting the cap C1 is formed on the outer peripheral surface of the front-side cylindrical portion 6*b*. For example, three protrusions 6*d* are formed and these three protrusions 6*d* are arranged in the circumferential direction of the spring member 6 at equal intervals.

The rear-side cylindrical portion 6*c* of the spring member 6 includes: an annular convex portion 6*e* formed on the outer peripheral surface thereof; and a spring portion 6*f* positioned on the rear side of the annular convex portion 6*e*. The spring portion 6*f* is a resin spring configured to stretch and compress in the axial direction. The spring portion 6*f* is defined by a slit 6*g* formed in the main body portion 6*h*, which extends in a spiral shape along the circumferential surface, providing an opening between an inside and an outside of the spring. The spring portion 6*f* can be stretched or contracted to alleviate an impact caused when an external force is applied.

The flange portion 6*a* is engaged with the annular concave portion 4*a* formed on the front end of the inner peripheral surface of the container main body 4. Further, the annular convex portion 6*e* is engaged with the annular concave portion 4*b* positioned on the rear side of the annular concave portion 4*a*, in the axial direction. The container main body 4 is mounted to the tip cylinder 3 to be rotatable relative to the tip cylinder 3, around the axis line, and to be fixed (or "immovable") relative to the tip cylinder 3, in the axial direction. In addition, an annular protruding portion 4*c* with which the rear end of the spring member 6 is brought into contact; and a knurl 4*d* which is engaged with a female screw member 7 in the rotation direction on the rear side of the annular protruding portion 4*c* are provided on the inside of the container main body 4 and the rear side of the spring member 6.

Figure 5:
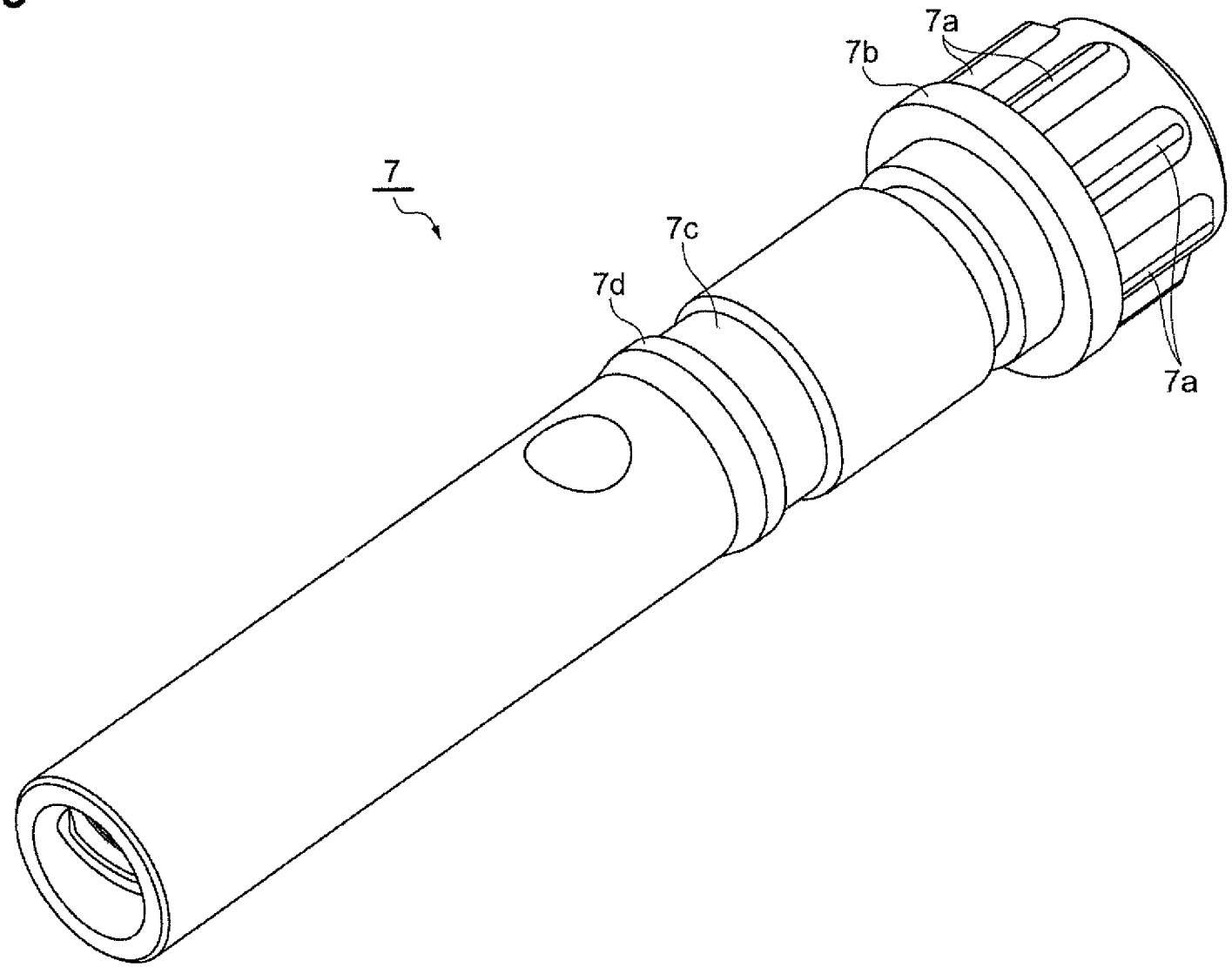
FIG. 5 is a perspective view illustrating a female screw member of the stick-shaped cosmetic material dispensing container of FIG. 1

As illustrated in FIGS. 2 and 5, the female screw member 7 is formed in a substantially cylindrical shape. A projection 7*a* which is engaged with the knurl 4*d* of the container main body 4 in the rotation direction, extends in the axial direction, and is disposed in parallel along the circumferential direction is provided on the rear side of the outer peripheral surface of the female screw member 7. Due to this engagement of the projection 7*a* with the knurl 4*d* in the rotation direction, the female screw member 7 is provided synchronously rotatable (non-rotatable) with respect to the container main body 4.

The female screw member 7 is formed of, for example, polyacetal (POM). A flange portion 7*b* which is brought into contact with the rear end of the tip cylinder 3 from the rear side; and an annular concave portion 7*c* and an annular convex portion 7*d* which are engaged with the tip cylinder 3 in the axial direction are provided on the outer peripheral surface of the female screw member 7 on the front side of the projection 7*a*. The annular concave portion 7*c* is engaged with an annular convex portion 3*t* formed on the inner peripheral surface of the tip cylinder 3 in the axial direction; and the annular convex portion 7*d* is engaged with an annular concave portion 3*v* formed on the inner peripheral surface of the tip cylinder 3 in the axial direction. Moreover, a female screw portion 7*e* that functions as a female screw constituting one thread portion 10 is provided on the inner peripheral surface of the female screw member 7 on the rear side and a rear end portion of the moving body 5 is threadedly engaged with the female screw portion 7*e*.

Figure 6:
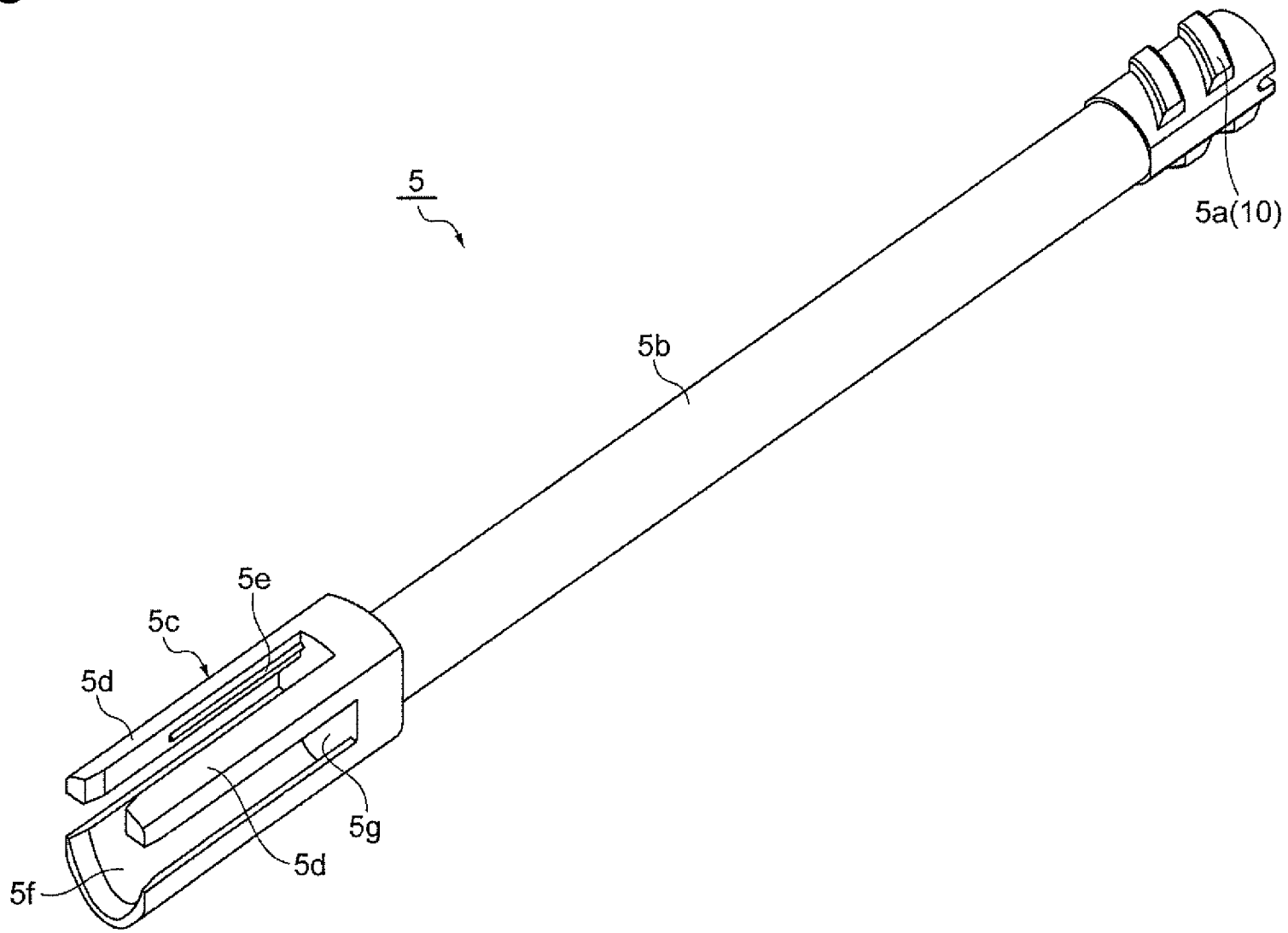
FIG. 6 is a perspective view illustrating a moving body of the stick-shaped cosmetic material dispensing container of FIG. 1.

As illustrated in FIGS. 2 and 6, the moving body 5 is a stick-shaped cosmetic material support that supports the cosmetic stick M with the front end thereof. The moving body 5 is disposed in the tip cylinder 3 and the female screw member 7 and extends in the axial direction. The moving body 5 is provided movably with respect to the tip cylinder 3 in the axial direction and has a round stick shape as a whole. The moving body 5 is formed of polybutylene terephthalate (PBT).

The moving body 5 includes a thread protrusion 5*a*, which functions as a male screw constituting the other tread portion 10, on the outer peripheral surface of the read end portion thereof. The moving body 5 includes a round stick-shaped axis body portion 5*b* positioned on the front side of the thread protrusion 5*a*; and a support portion 5*c* which is provided on the front end of the moving body 5 and supports the rear end portion of the cosmetic stick M.

The support portion 5*c* includes a base 5*g* with which the rear end surface of the cosmetic stick M is brought into contact; two first support pieces Sd which support the rear end portion of the cosmetic stick M; and one second support piece 5*f*. The first support piece 5*d* and the second support piece 5*f* are provided along the outer peripheral surface of the base 5*g* and protrude forward. A pair of two first support pieces 5*d* protrude from the base 5*g*, and a rib 5*e* extending in the axial direction is provided in the inner surface of each of the first support pieces 5*d*.

The second support piece 5*f* is curved in a curved shape so as to partially surround the cosmetic stick M on the opposite side of two first support pieces 5*d* of the moving body 5 in the radial direction. The rear end portion of the cosmetic stick M is supported by being fitted to a region between the support pieces, which comprise the first support pieces 5*d* and the second support piece 5*f*.

Next, the cosmetic stick M and the tip cylinder 3 will be described in detail with reference to FIGS. 7 and 8. As described above, the tip cylinder 3 (or dispensing portion) includes the holding portion 3*d* (also referred to herein as "support" or "holding member") that holds the cosmetic stick M on the front end thereof (i.e. an application end of the cosmetic stick M). The holding portion 3*d* is formed such that one side surface of the tip cylinder 3 is notched in the radial direction (i.e. notched from the side) and also notched from the front end 3*h* (i.e. notched from the tip end) of the tip cylinder 3 toward the rear side.

The holding portion 3*d* is shaped to taper toward the front side (toward the tip end). The holding portion 3*d* is formed to include the end surface of the front end of the tip cylinder 3 that is notched by the front end of the inclined surface 3*c*. The holding portion 3*d* includes a first curved portion 3*e* which extends to one side (lower side in FIGS. 7 and 8) of the tip cylinder 3 in the radial direction from the inclined surface 3*c* and is curved; an extending portion 3*f* which extends from the front end of the first curved portion 3*e* substantially in the axial direction; and a second curved portion 3*g* which is curved to one side of the tip cylinder 3 in the radial direction from the front end of the extending portion 3*f*.

The first curved portion 3*e* is curved to one side in the radial direction from the inclined surface 3*c* and is gradually curved in the axial direction toward one side in the radial direction. The lengths of the first curved portion 3*e*, the extending portion 3*f*, and the second curved portion 3*g* (holding portion 3*d*) in the axial direction are respectively in a range of 3 mm to 15 mm. Further, the front end 3*h* of the second curved portion 3*g* is a portion of the tip cylinder 3 at which the cosmetic stick M appears or disappears (i.e. exposed or hidden). The second curved portion 3*g* is gradually curved to one side in the radial direction from the extending portion 3*f* toward the front end 3*h*. The first curved portion 3*e*, the extending portion 3*f*, the second curved portion 3*g* and the front end 3*h* define a contour of the outlet of the dispensing portion (the cylinder tip 3), for dispensing the cosmetic stick M.

Figure 8:
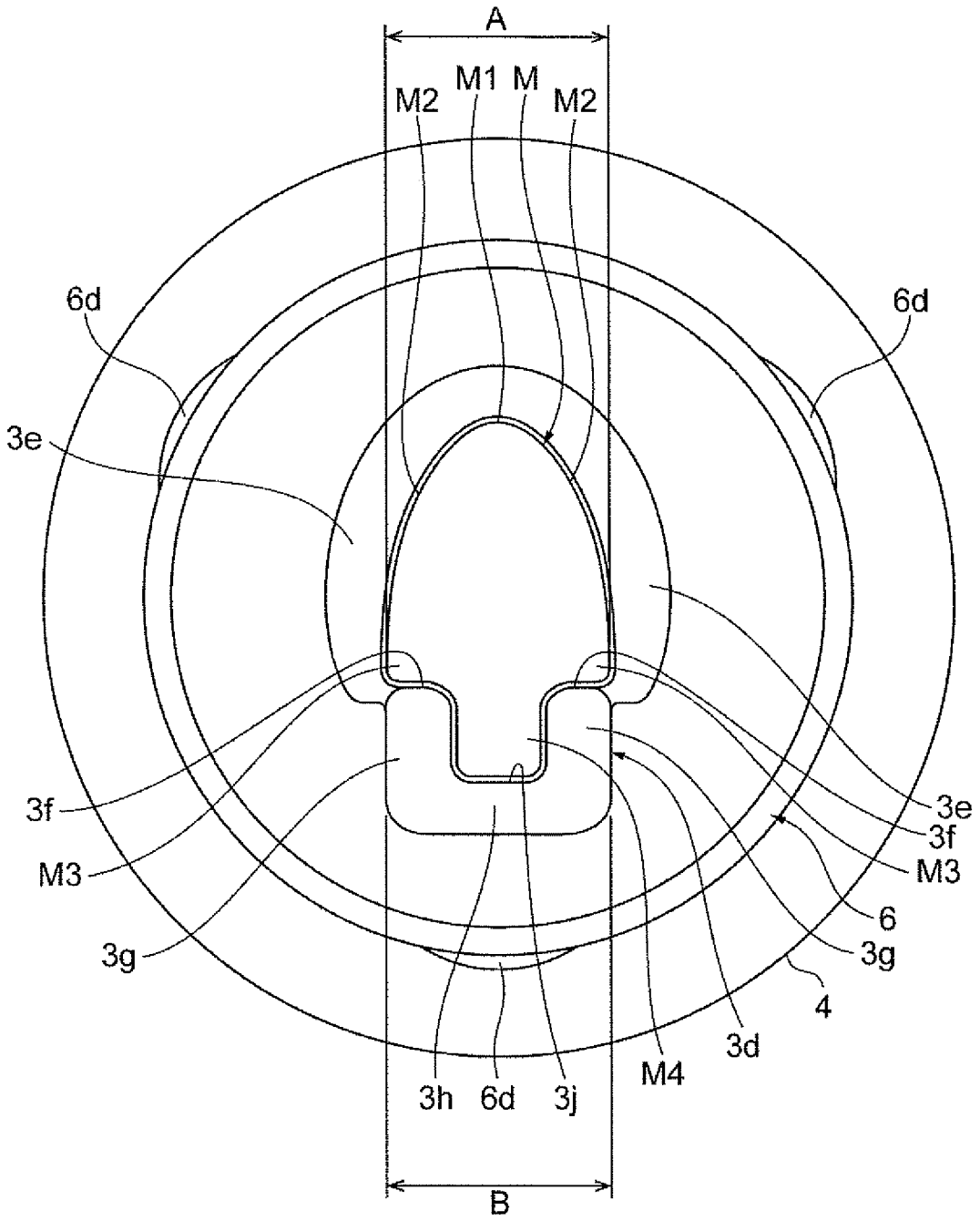
FIG. 8 is a view illustrating a holding portion of the tip cylinder and the stick-shaped cosmetic material of FIG. 7 when viewed from the front side.

As shown in FIG. 8, pairs of left and right first curved portions 3*e*, left and right extending portions 3*f*, and left and right second curved portions 3*g* are provided about the cosmetic stick M when viewed from the front side (i.e. from the application tip end). The left and light extending portions 3*f* and the second curved portions 3*g* form a pair of projections which extend along edge portions of the support and which project toward the cosmetic stick M, so that the support (or holding portion 3*d*) has a substantially U-shaped cross-section. When viewed from the front side (i.e. from the tip end), a concave portion 3*j* is formed of a pair of inside surfaces of the second curved portion 3*g* and the inside surface of the front end 3*h*. The concave portion 3*j* extends in the axial direction on the inner peripheral surface of the tip cylinder 3, and extends to the holding portion 3*d*. In FIG. 8, the profiled guide of the holding portion 3*d* (support) comprises the pair of projections that form the concave portion 3*j*. The projections comprise end surfaces, corresponding to the left and right extending portions 3*f*, which are configured to contact the profiled contact surface of the cosmetic stick M. A central recessed portion of the profiled guide, corresponding to the inside surface of the front end 3*h*, is stepped and recessed relative to the end surfaces 3*f* of the projections. The recessed central portion comprises a substantially flat surface and the projections extend perpendicularly relative to the substantially flat surface. Thus, the profiled guide extends along a profiled support surface in which the end surfaces 3*f* of the projections include stepped side portions that are stepped relative to a central portion 3*j* (e.g. the central recessed portion) and located on each side of the central portion. The stepped side portions comprise substantially flat portions. The substantially flat portions of the recessed central portion and of the stepped side portions extend parallel to the axis of the main body, and the pair of projections comprise wall surfaces, each located between the central portion and one of the stepped side surfaces (for example the pair of inside surfaces of the second curved portion 3*g*), that extend substantially perpendicularly relative to the central portion.

In the holding portion 3*d*, the cosmetic stick M extends to the front side from the first curved portion 3*e* and is curved to one front side of the extending portion 3*f* in the radial direction. When viewed from the front side (i.e. from the application tip end), as shown in FIG. 8, the cosmetic stick M has an opposing portion M3 that faces the holding member 3*d*, and is configured for engaging with the holding member 3*d*. The cosmetic stick M extends away from the holding member 3*d* in a tapered shape.

In FIG. 8, the cosmetic stick M includes a vertex M1; a pair of left and right curved portions M2 on both sides which extend from the vertex M1 to the extending portion 3*f*; a pair of opposing portions M3 as described above; and a convex portion M4 which protrude from a region between the pair of opposing portions M3. The vertex M1 is positioned at a location farthest from the extending portion 3*f*. The curved portions M2 are isolated to have a shape along the outer periphery of an ellipse. The opposing portions M3 are positioned at ends of each curved portion M2, opposite the vertex M1. The cosmetic stick M includes an application surface, and the above-mentioned profiled contact surface opposite the application surface. The application surface comprises the curved portions M2 and the vertex M1, and the profiled contact surface comprises the opposing portions M3 and a surface of the convex portion M4. Accordingly, the cosmetic stick M narrows from a portion adjacent the profiled contact surface M3, M4 toward the vertex M1 of the application surface M2, M1.

The convex portion M4 is a portion held by the concave portion 3*j* and protrudes to the concave portion 3*j* from the region between the pair of opposing portions M3. Further, a gap is formed between the cosmetic stick M and the holding portion 3*d* (between the concave portion 3*j* and the convex portion M4). It is desired that this gap is as small as possible. Due to this gap, shaking of the cosmetic stick M is reduced even when a force is applied to a side surface of the cosmetic stick M at the time of use, and thus the cosmetic stick M is less likely to be broken.

When viewed from the front side, where the width of the opposing portions M3 of the cosmetic stick M is set as a width A (or simply A) and the width of the front end 3*h* of the holding portion 3*d* (or support) is set as a width B (or simply B), the width A is substantially the same as the width B. The width A indicates the maximum width of the front end of the cosmetic stick M when the cosmetic stick M is viewed from the front side; and the width B indicates the maximum width of the front end 3*h* of the holding portion 3*d* when the holding portion 3*d* is viewed from the front side. Specifically, the width B of the pair of second curved portions 3*g* when viewed from the front side is substantially the same as the width A of the opposing portions M3 of the cosmetic stick M. As for the expression "substantially the same", the difference between the width A of the cosmetic stick M and the width B the holding portion 3*d* (for example, the value of B-A or of A-B) may be between 0.0 mm and 1 mm, and preferably between 0.0 mm and 0.6 mm. Additionally or alternatively, the difference between the widths of the cosmetic stick M and the holding portion 3*d* may be within about 25%, and preferably within about 10 to 15%, for example, relative to the width of the cosmetic stick M or relative to the width of the holding portion 3*d*. The width B may measure within a range of about 1 to 3 mm, preferably within a range of about 2 to 3 mm, for example 2.5 mm. The width A may measure within a range of 1 to 3 mm, preferably within a range of about 2 to 3 mm, for example 2.5 mm. In one or more alternate embodiments, the width A of the cosmetic stick M is greater than the width B of the front end 3*h* of the holding portion 3*d*.

In the cosmetic dispensing container 1 described above, a method of dispensing or retreating the cosmetic stick M so that the moving body 5 advances or retracts and the cosmetic stick M appears or disappears will be described. First, with reference to FIG. 2, when the cap C1 is removed and the container main body 4 is rotated relative to the tip cylinder 3 in one direction (for example, clockwise), then the container main body 4, the spring member 6, and the female screw member 7 synchronously rotate, and the moving body 5 advances toward the tip cylinder due to the thread-engagement action of the thread portion 10 comprising the female screw portion 7*e* of the female screw member 7 and the thread protrusion 5*a* of the moving body 5. The cosmetic stick M appears from the front end 3*h* of the tip cylinder 3 due to the advancement of the moving body 5 so that the cosmetic stick M is dispensable.

Further, when the container main body 4 is rotated relative to the tip cylinder 3, in a direction opposite to the one direction (for example, counterclockwise), the container main body 4, the spring member 6, and the female screw member 7 synchronously rotate and the moving body 5 retracts due to the thread-engagement action of the thread portion 10. In this manner, the cosmetic stick M supported by the moving body 5 retreats away from the front end 3*h*.

Figure 7:
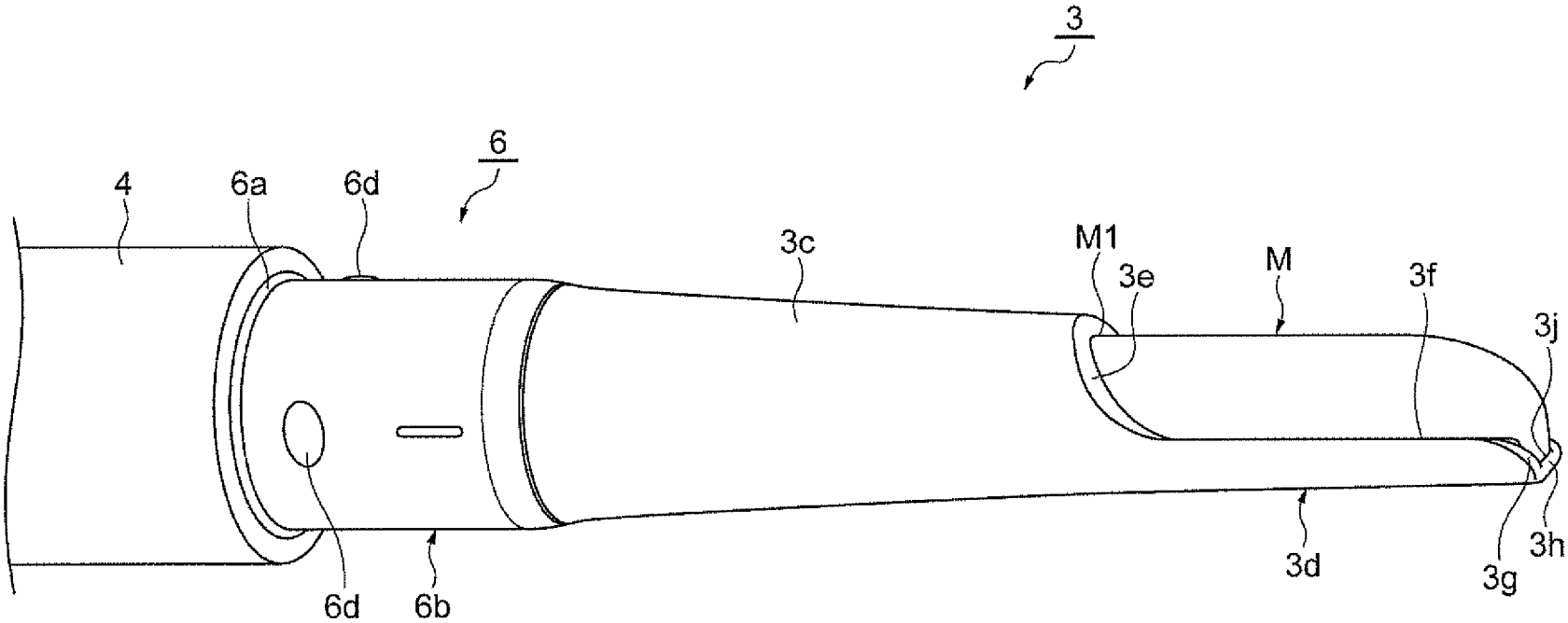
FIG. 7 is a perspective view illustrating a stick-shaped cosmetic material and the tip cylinder of FIGS. 3A and 3B by enlarging the portions.

As described above, according to the cosmetic dispensing container 1 of the present embodiment, the tip cylinder 3 includes the holding portion 3*d* that holds the cosmetic stick M, and the concave portion 3*j* extending in the axial direction extends to the holding portion 3*d* as illustrated in FIGS. 7 and 8. Further, the convex portion M4 which extends in the axial direction and is held by the concave portion 3*j* is formed on the outer peripheral surface of the cosmetic stick M.

Accordingly, since the convex portion M4 of the cosmetic stick M is held by the concave portion 3*j* of the holding portion 3*d*, the cosmetic stick M can be substantially rigidly held by the holding portion 3*d* due to the concave portion 3*j* holding the convex portion M4. Consequently, the cosmetic stick M can be substantially rigidly held by the concave portion 3*j* holding the convex portion M4 even when a force is applied to the cosmetic stick M in any direction. Therefore, shaking of the cosmetic stick M is reduced so that the risk of breaking the cosmetic stick M can be substantially reduced.

Further, the shape of the cosmetic stick M when viewed from the front side is formed to be tapered as a distance from the opposing portions M3 increases, and the width A of the opposing portions M3 of the cosmetic stick M when viewed from the front side is substantially the same as the width B of the holding portion 3*d* when viewed from the front side. Accordingly, the holding portion 3*d* at the time of applying make-up is less likely to interrupt the field of vision because the width B of the holding portion 3*d* is substantially the same as the width A of the cosmetic stick M.

Since the holding portion 3*d* does not interrupt the field of vision, a user may better see the application apply surface and apply the make up with more ease. Therefore, the usability can be improved.

Second Group of Embodiments

Figure 9:
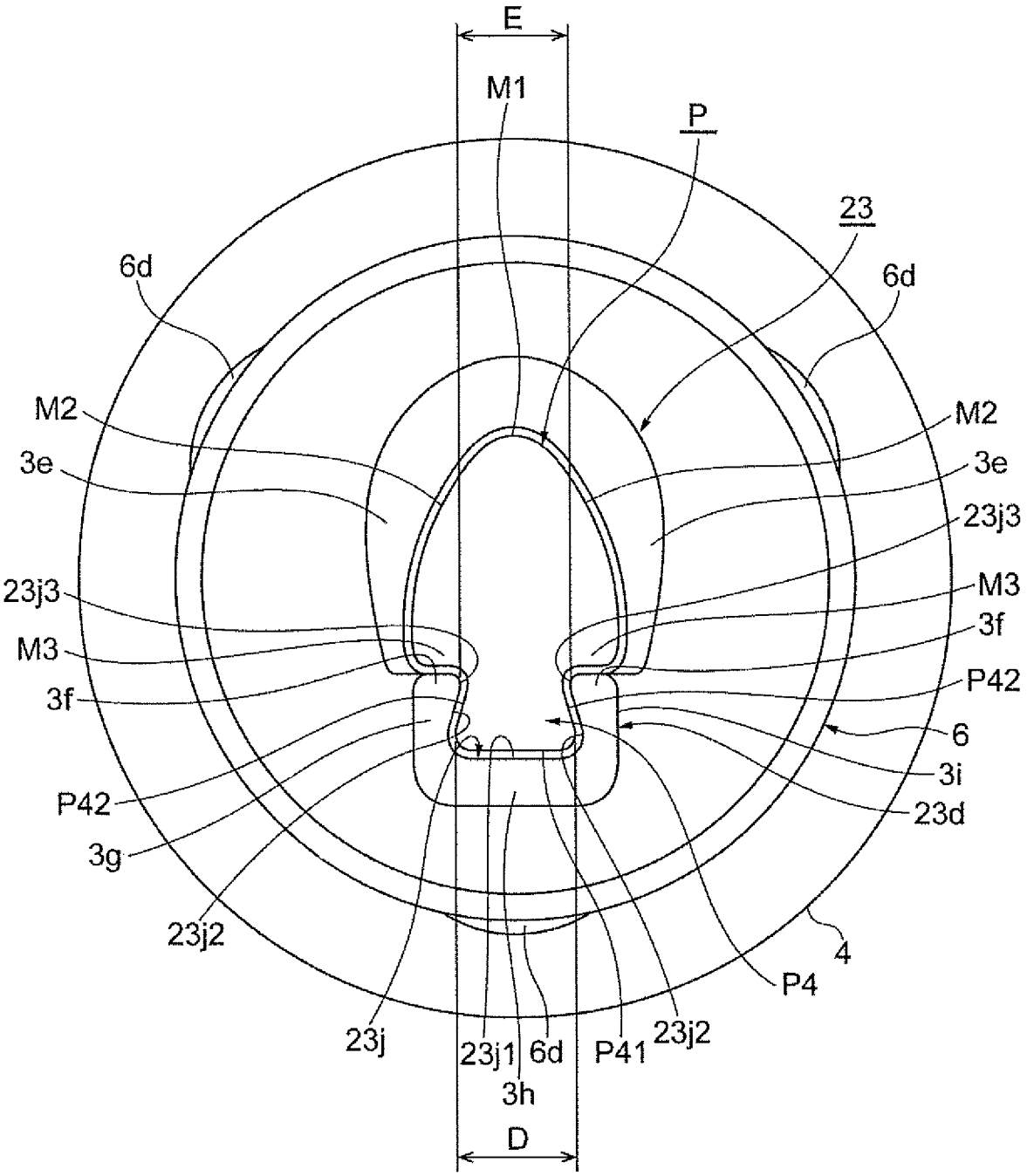
FIG. 9 is a view illustrating a holding portion of a tip cylinder and a stick-shaped cosmetic material of a stick-shaped cosmetic material dispensing container when viewed from the front side according to a second group of embodiments.

Next, a cosmetic dispensing container according to a second group of embodiments will be described with reference to FIG. 9. FIG. 9 illustrates a tip cylinder 23 and a stick-shaped cosmetic material P (also referred to herein as "cosmetic stick P") of the cosmetic dispensing container according to the second embodiment when viewed from the front side. The second embodiment is different from the first embodiment in terms of the configurations of the tip cylinder 23 and the cosmetic stick P. Hereinafter, some of the features that are common with those of the cosmetic dispensing container according to the first embodiment, will not be described.

The tip cylinder 23 includes a holding portion 23*d* which holds the cosmetic stick P, and a concave portion 23*j* which extends in the axial direction is formed on the holding portion 23*d*. A convex portion P4 which extends in the axial direction is formed on the outer peripheral surface of the cosmetic stick P, and is held by the concave portion 23*j* of the holding portion 23*d*. Since the convex portion P4 of the cosmetic stick P is held by the concave portion 23*j* of the holding portion 23*d*, the cosmetic stick P can be rigidly held by the holding portion 23*d* due to the holding of the convex portion P4 by the concave portion 23*j*.

Both of the shape of the convex portion P4 when viewed from the front side and the shape of the concave portion 23*j* when viewed from the front side follow the shape of an isosceles trapezoid having an upper base is shorter than the lower base thereof. The convex portion P4 includes a bottom P41 which extends in the width direction of the cosmetic stick P; and a pair of outside surfaces P42 which extend to the vertex M1 side of the cosmetic stick P from the ends of the bottom P41 in the width direction. The bottom P41 and the outside surfaces P42 are formed to be flat. The concave portion 23*j* has a similar shape as that of the convex portion P4.

In FIG. 9, the profiled guide of the support comprises the concave portion 23*j* and a pair of projections having end surfaces corresponding to the left and right extending portions 3*f*, which are configured to contact the profiled contact surface M3, P4 of the cosmetic stick P. The concave portion 23*j* includes: a flat surface 23*j*1 opposite (i.e. facing) the bottom P41 of the cosmetic stick P; and a pair of inside surfaces 23*j*2 which extend from each end of the flat surface 23*j*1 in the width direction, toward the vertex M1 side of the cosmetic stick P. A width D of a portion of the convex portion P4 entering the concave portion 23*j* is larger than a width E of an opening portion 23*j*3 of the concave portion 23*j*. Here, the "width of the portion of the convex portion entering the concave portion" indicates a portion of the convex portion P4 entering the concave portion 23*j*, which is a portion positioned on a deeper side of the concave portion 23*j* than the opening portion 23*j*3. The opening portion 23*j*3 indicates an edge portion of the concave portion 23*j*. Accordingly, the projections comprise inner side surfaces 23*j*2 between the end surfaces 3*f* and the recessed central portion (flat surface 23*j*1), and the inner side surfaces 23*j*2 are closer to each other toward the end surfaces 3*f* than toward the recessed central portion 23*j*1. Further, the projections extend substantially perpendicularly relative to a substantially flat surface of the recessed central portion 23*j*1, and the projections are wider toward the end surfaces 3*f* than toward the recessed central portion 23*j*1. The projections comprise outer side surfaces 3*i* opposite the inner side surfaces 23*j*2, which are oriented substantially perpendicularly relative to the recessed central portion 23*j*1.

As described above, in the cosmetic dispensing container according to the second embodiment, the concave portion 23*j* which extends in the axial direction is formed on the inner peripheral surface of the tip cylinder 23; and the convex portion P4 which extends in the axial direction and is held by the concave portion 23*j* is formed on the outer peripheral surface of the cosmetic stick P. The width D of the portion of the convex portion P4 entering the concave portion 23*j* when viewed from the front side is larger than the width E of the opening portion 23*j*3 of the concave portion 23*j* when viewed from the front side.

Accordingly, when a force is applied to the cosmetic stick. P in a direction (upward direction in FIG. 9) of detachment of the cosmetic stick P from the concave portion 23*j*, detachment of the convex portion P4 from the concave portion 23*j* and breakage of the cosmetic stick P can be reliably reduced by bringing the outside surfaces P42 of the convex portion P4 into contact with the inside surfaces 23*j*2 of the concave portion 23*j*. In other words, the resistance of the cosmetic stick P to the force applied in the direction of detachment of the convex portion P4 from the concave portion 23*j* can be increased, and thus the breakage of the cosmetic stick P can be further reliably reduced.

By forming the inside surfaces 23*j*2 of the concave portion 23*j* and the outside surfaces P42 of the convex portion P4 to be flat, the area where the outside surfaces P42 are in contact with the inside surfaces 23*j*2 can be increased. Therefore, the breakage of the cosmetic stick P can be further reliably reduced since the stress applied to the cosmetic stick P can be reduced.

Hereinbefore, embodiments of the cosmetic dispensing container have been described, but the embodiments are not limited to the above-described embodiments and modifications can be made within the range not changing the gist described in the claims. That is, the shape and the disposition mode of each component constituting the cosmetic dispensing container 1 can be appropriately changed within the range not changing the gist described above.

Figure 10:
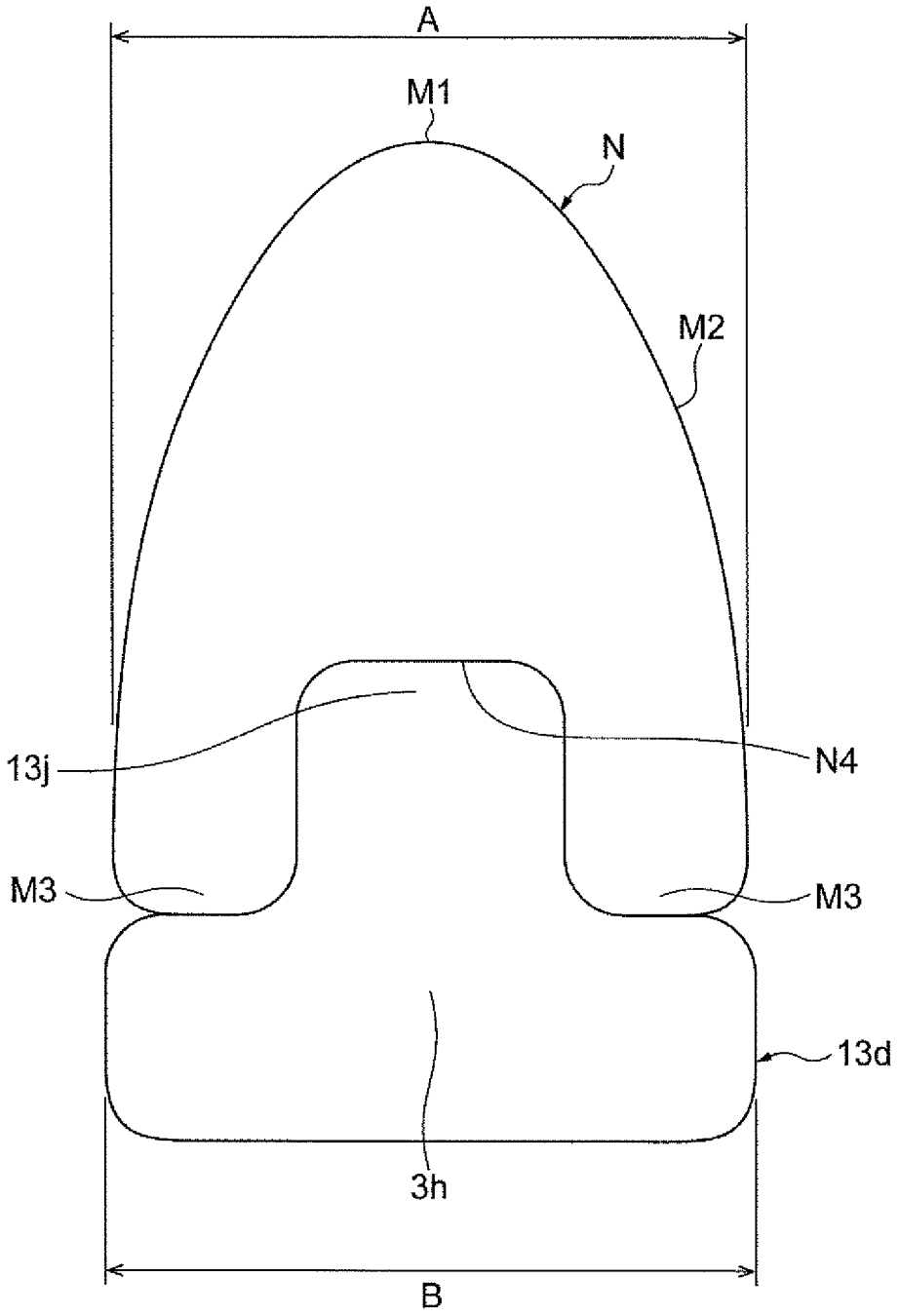
FIG. 10 is a view illustrating a holding portion and a stick-shaped cosmetic material when viewed from the front side according to a modified example of FIG. 8.

In the embodiment described above, the example in which the cosmetic dispensing container includes the holding portion 3*d* that has the concave portion 3*j* and the cosmetic stick M that has the convex portion M4 has been described. However, as illustrated in FIG. 10, the cosmetic dispensing container may include a holding portion 13*d* that has a convex portion 13*j* and a stick-shaped cosmetic material N (also referred to herein as "cosmetic stick N") that has a concave portion N4 in place of the holding portion 3*d* and the cosmetic stick M. Similarly, when the width A of the opposing portion M3 of the cosmetic stick N when viewed from the front side is substantially the same as the width B of the holding portion 13*d* when viewed from the front side, the same effects as those of the embodiments described above are obtained. Thus, the profiled contact surface of the cosmetic stick N comprises a groove (e.g. concave portion N4), and the profiled support surface of the support 13*d* comprises a tongue projection (i.e. convex portion 13*j*) that extends along a central portion of the support 13*d* and projects into the groove N4 of the cosmetic stick N, so that the support 13*d* has a substantially T-shaped cross-section. Thus, the profiled guide extends along a profiled support surface comprising a central portion (e.g. a top surface of the convex portion 13*j*) extending parallel to the axis of the main body, and stepped side portions (facing the opposing portion M3 of the cosmetic stick N) that are stepped relative to the central portion and located on each side of the central portion. The stepped side portions are recessed relative to the central portion of the profiled support surface of the dispenser, so that the support has a substantially T-shaped cross-section.

Figure 11:
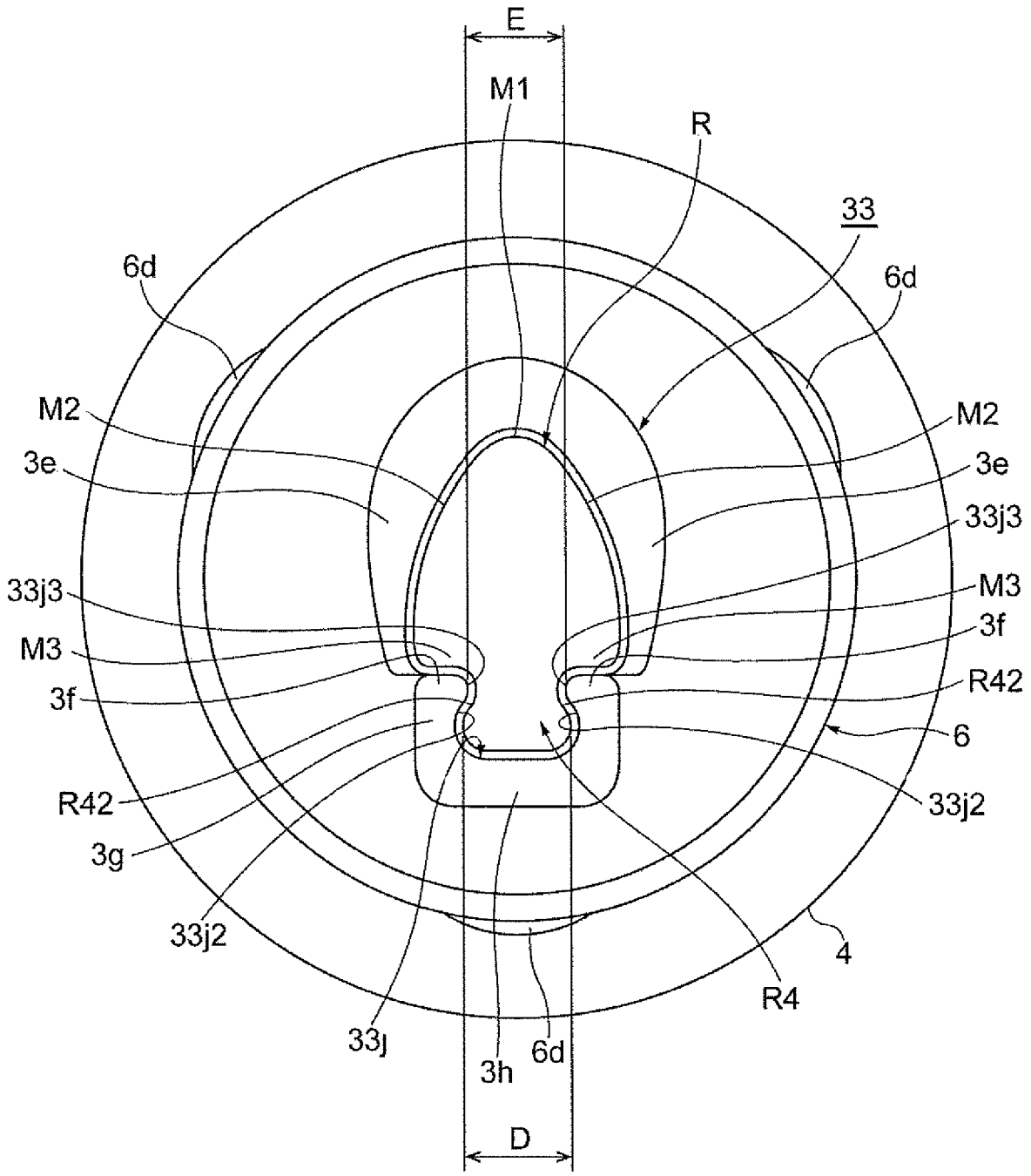
FIG. 11 is a view illustrating a holding portion and a stick-shaped cosmetic material when viewed from the front side according to a modified example of FIG. 9.

In the embodiment described above, as illustrated in FIG. 9, the tip cylinder 23 that includes the concave portion 23*j* having the flat inside surfaces 23*j*2; and the cosmetic stick P that includes the convex portion P4 having the flat outside surfaces P42 has been described. However, as illustrated in FIG. 11, a tip cylinder 33 that includes a concave portion 33*j* having curved inside surfaces 33*j*2; and a stick-shaped cosmetic material R (also referred to herein as "cosmetic stick R") that includes a convex portion R4 having curved outside surfaces R42 may be employed.

Figure 12:
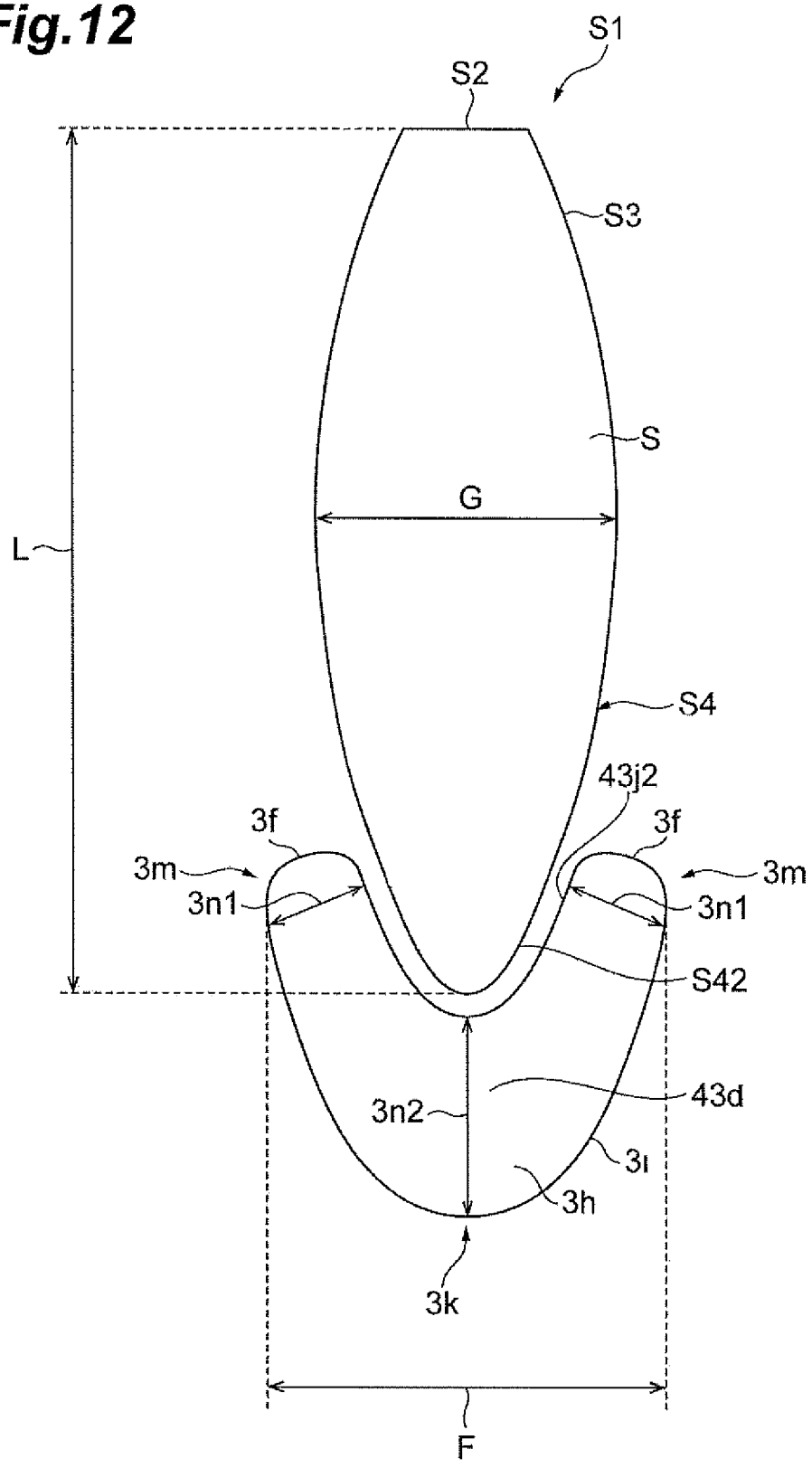
FIG. 12 is a view illustrating a holding portion and a stick-shaped cosmetic material when viewed from the front side according to another group of embodiments.

Even in the cosmetic stick R and the tip cylinder 33, the width D of the portion of the convex portion R4 entering the concave portion 33*j* when viewed from the front side is larger than the width E of an opening portion 33*j*3 of the concave portion 33*j* when viewed from the front side. Accordingly, when a force is applied to the cosmetic stick R in a direction (upward direction in FIG. 11) of detachment of the cosmetic stick R from the concave portion 33*j*, the outside surfaces R42 of the convex portion R4 are brought into contact with the inside surfaces 33*j*2 of the concave portion 33*j*. Therefore, since detachment of the convex portion R4 from the concave portion 33*j* is more reliably reduced, and the resistance of the cosmetic stick R to the force applied in the direction of the convex portion R4 being detached from the concave portion 33*j* can be improved, the breakage of the cosmetic stick R can be more reliably reduced. As illustrated in the example of FIG. 11 and the example of FIG. 9, the shape of the inside surface of the concave portion and the shape of the outside surface of the convex portion can be changed as appropriate. FIG. 12 shows a holding portion (or support) 43*d* and a cosmetic stick S, according to another group of embodiment, as seen from the front end 3*h*. The cosmetic stick S may have a cross-section that is substantially oval, having a length L and a width G. The length L may be within a range of about 4 to 5 mm, for example a length L of about 4.6 mm. The width G may be within a range of about 1 to 2 mm, preferably within a range of about 1.5 to 2 mm. The substantially oval cross-section is truncated at an end S1 opposite the support 43*d*, the truncated end S1 forming a substantially flat surface S2. The cosmetic stick S comprises an outside surface S42, including a contact surface S4 for contacting the support 43*d* and an application surface S3 opposite the contact surface S4. The application surface S3 of the cosmetic stick S includes the substantially flat surface S2. The shape of the support 43*d* can be substantially V-shaped, U-shape or the like, in order to conform with the shape of the contact surface S4 of the cosmetic stick S. The support 43*d* has an inner surface 43*j*2 that engages the contact surface S4 of the cosmetic stick 5, and an outer surface 3*i* opposite the inner surface 43*j*2. A thickness of the support 43*d* is defined by a distance between the inner surface 43*j*2 and the outer surface 3*i*. The support 43*d* has a valley portion 3*k* and extremities 3*m* near the extending portions 3*f*. The thickness 3*n*1 of the support 43*d* at the extremities 3*m* is smaller than the thickness 3*n*2 at the valley portion 3*k*. The inner surface 43*j*2 comprises substantially flat surfaces between the valley 3*k* and the extremities 3*m*. The thickness 3*n*1 may be within a range of about 0.5 to 0.8 mm, preferably between about 0.6 and 0.7. The thickness 3*n*2 may be within a range of about 0.5 to 2 mm, preferably within a range of about 1 to 1.3 mm. The support 43*d* has a width F that may be within a range of about 2 to 3 mm, preferably within a range of about 1.5 to 2.5 mm. In some embodiments the width F of the support 43*j*2 is substantially equal to the width G of the cosmetic stick S, for example, a difference between the widths F and G is within 1 mm, or within 25%, preferably within 10-15%, relative to the largest width among the width F of the support and the width G of the cosmetic stick S. In accordance with one or more embodiments, the portion of the support 43*d* which is configured to engage with the cosmetic stick S comprises at least one flat surface. In accordance with one or more embodiments, the portion of the support 43*d* which is configured to engage with the cosmetic stick S comprises at least two flat surfaces.

Further, in the embodiment described above, as illustrated in FIG. 8, the cosmetic stick M in which the vertex M1, the curved portion M2, and the opposing portion M3 have an elliptical shape has been described, but the shape of the cosmetic stick M can be changed as appropriate. For example, portions corresponding to the vertex portion M1, the curved portion M2, and the opposing portion M3 may have a triangular shape, a parabolic shape, an oval shape, an arc shape, a polygonal shape and/or the like, so as to be tapered as a distance from the portion M3 increases. Accordingly, the shape of the cosmetic stick is not limited.

Further, in the embodiment described above, as illustrated in FIG. 7, the example in which the cosmetic dispensing container includes the holding portion 3*d* including the first curved portion 3*e*, the extending portion 3*f*, and the second curved portion 3*g* has been described. However, the shape of the holding portion 3*d* can be changed as appropriate. Further, the lengths and the shapes of the first curved portion 3*e*, the extending portion 3*f*, and the second curved portion 3*g* can be changed as appropriate. Particularly, according to the embodiment described above, even when the holding portion 3*d* extends lengthwise in the axial direction, the holding force of the cosmetic stick M can be more reliably obtained, and thus it is particularly effective that the holding portion 3*d* extends lengthwise (for example, a case where the length of the holding portion 3*d* in the axial direction is 15 mm or greater).

Further, in the embodiment described above, the cosmetic dispensing container 1 including the container 2 which includes the tip cylinder 3 and the container main body 4; the moving body 5; the spring member 6; the female screw member 7; the flange portion 8; and the caps C1 and C2 has been described. However, for example, the flange portion 8 and the cap C2 may not be provided in the cosmetic dispensing container according to one or more embodiments. In addition, the shapes, the sizes, and the materials of the container 2, the moving body 5, the spring member 6, and the female screw member 7 can be changed as appropriate.

Further, in the embodiments described above, the example in which the cosmetic stick M comprises eyebrow make-up and the cosmetic dispensing container 1 is an eyebrow make-up dispensing container has been described. However, the stick-shaped cosmetic material dispensing container according to one or more embodiments can be applied to various stick-shaped cosmetic materials such as eyeliners, concealers, and lip liners.

It is to be understood that not all aspects, advantages and features described herein may necessarily be achieved by, or included in, any one particular example embodiment. Indeed, having described and illustrated various examples herein, it should be apparent that other examples may be modified in arrangement and detail. We claim all modifications and variations coming within the spirit and scope of the subject matter claimed herein.

What is claimed is:

1. A stick-shaped cosmetic material dispensing container comprising:

a cylindrical container which includes a container front portion and a container rear portion mounted on the container front portion to be rotatable around an axis line of the cylindrical container and immovable relative to the container rear portion in an axial direction of the cylindrical container;

a moving body which is movable in the axial direction with respect to the container front portion, holds a stick-shaped cosmetic material with a front end thereof, and includes a male screw on an outer periphery thereof; and a female screw member which is not rotatable around the axis line with respect to the container rear portion and includes a female screw that is threadedly engaged with the male screw on an inner periphery thereof, wherein a thread-engagement action of a thread portion formed of the male screw and the female screw works due to relative rotation of the container front portion and the container rear portion so that the moving body advances and retracts, and the stick-shaped cosmetic material appears or disappears from a front end of the container front portion along with the advance or retract of the moving body, the container front portion is notched backward from the front end to form a holding portion that holds the stick-shaped cosmetic material, the holding portion is shaped so as to be tapered toward a front side of the holding portion, the container front portion comprises an inner peripheral surface extending to the holding portion, wherein the inner peripheral surface comprises either a concave portion or a convex portion extending in the axial direction, the stick-shaped cosmetic material comprises an outer peripheral surface including a contact portion having a shape that is complementary to the inner peripheral surface of the holding portion, so as to be held by the holding portion of the container front portion, the stick-shaped cosmetic material tapers away from the holding portion in a direction that is perpendicular to the axial direction of the cylindrical container and that is perpendicular to a width direction of the container front portion, and a width of the contact portion of the stick-shaped cosmetic material is the same as or greater than a width of the holding portion, taken in the width direction at the front end of the container front portion.

2. The stick-shaped cosmetic material dispensing container according to claim 1, wherein the inner peripheral surface of the container front portion which includes the concave portion, the concave portion including an opening portion that extends along the axial direction of the cylindrical container, wherein the contact portion of the stick-shaped cosmetic extends in the axial direction and is held by the concave portion of the container front portion, wherein the contact portion is a convex portion formed on the outer peripheral surface of the stick-shaped cosmetic material, and wherein a width of the convex portion of the stick-shaped cosmetic, taken in the width direction of the container front portion, is greater than a width of the opening portion of the concave portion of the container front portion, taken in the width direction.

3. The stick-shaped cosmetic material dispensing container according to claim 1, wherein the inner peripheral surface of the holding portion comprises a central portion extending parallel to the axis of the main body, and stepped side portions that are stepped relative to the central portion and located on each side of the central portion, wherein the central portion and the stepped side portions are configured to contact the contact portion of the stick-shaped cosmetic material.

4. The stick-shaped cosmetic material dispensing container according to claim 1, wherein the outer peripheral surface of the stick-shaped cosmetic material comprises an application surface opposite the contact portion, wherein the application surface has an exposed portion to appear from the front end of the container front portion, and wherein the exposed portion extends longitudinally, in parallel to the axial direction of the cylindrical container.

5. A dispensing container for dispensing a cosmetic, the dispensing container comprising:

a main body having an axis;

a cosmetic stick comprising an application surface and a profiled contact surface, wherein the profiled contact surface is opposite the application surface in a direction that is perpendicular to the axis of the main body and that is perpendicular to a width direction of the cosmetic stick;

a moving body that is operatively coupled to the main body and is configured to move the cosmetic stick along the axis of the main body; and a dispensing portion extending from the main body, the dispensing portion comprising a tip end opposite the main body, and a support that extends from the tip end along the axis of the main body for supporting the cosmetic stick, wherein the support comprises a profiled guide configured to engage the profiled contact surface of the cosmetic stick, and wherein the support has a width, taken at the tip end in the width direction of the cosmetic stick, that is equal to or less than a width of the cosmetic stick, taken in the width direction.

6. The dispensing container according to claim 5, wherein the width of the support measures within a range of about 1 to 3 mm, and the width of the cosmetic stick measures within a range of about 1 to 3 mm, and wherein a difference between the width of the support and the width of the cosmetic stick is 1 mm or less.

7. The dispensing container according to claim 5, wherein the profiled contact surface of the cosmetic stick includes a tongue projection that extends parallel to the axis of the main body, wherein the profiled guide of the support of the dispensing portion includes a groove that extends parallel to the axis of the main body, to receive the tongue projection of the cosmetic stick, and wherein a width of the groove taken in the width direction, narrows toward the application surface of the cosmetic stick.

8. The dispensing container according to claim 5, wherein the profiled contact surface of the cosmetic stick comprises a groove, and wherein the profiled guide of the support comprises a tongue projection that extends parallel to the axis of the main body along a central portion of the support and projects into the groove of the cosmetic stick, so that the support has a substantially T-shaped cross-section.

9. The dispensing container according to claim 5, wherein the profiled guide of the support comprises a pair of projections that extend parallel to the axis of the main body, and that project toward the cosmetic stick, so that the support has a substantially U-shaped cross-section.

10. The dispensing container according to claim 9, wherein the projections comprise end surfaces that are configured to contact the profiled contact surface of the cosmetic stick at the tip end of the dispensing portion, wherein the profiled guide comprises a recessed central portion between the projections, that is stepped and recessed relative to the end surfaces of the projections, wherein the recessed central portion comprises a substantially flat surface configured to contact the profiled contact surface of the cosmetic stick at the tip end of the dispensing portion, and wherein the projections extend substantially perpendicularly relative to the substantially flat surface.

11. The dispensing container according to claim 5, wherein the cosmetic stick narrows from a portion adjacent the profiled contact surface in a direction perpendicular to the axis of the main body toward a vertex of the application surface.

12. A dispensing container for dispensing a cosmetic stick comprising an application surface opposite a profiled contact surface, the dispensing container comprising:

a main body having an axis;

a moving body that is operatively coupled to the main body and is configured to move the cosmetic stick along the axis of the main body; and a dispensing portion extending from the main body, the dispensing portion comprising an outlet having a support that extends along the axis of the main body, wherein the support comprises a profiled support surface configured to engage the profiled contact surface of the cosmetic stick, and wherein the profiled support surface comprises a central portion extending parallel to the axis of the main body, and stepped side portions that are stepped relative to the central portion and located on each side of the central portion, and wherein the central portion and the stepped side portions are configured to contact the profiled contact surface of the cosmetic stick at the outlet.

13. The dispensing container according to claim 12, wherein the dispensing portion comprises a tip end opposite the main body, and wherein the central portion and the stepped side portions of the support extend to the tip end of the dispensing portion.

14. The dispensing container according to claim 13, wherein the stepped side portions are located on the sides of the central portion in a width direction of the support, and wherein a width of the tip end taken in the width direction of the support is substantially equal to or less than a width of the cosmetic stick.

15. The dispensing container according to claim 12, wherein the central portion comprises a flat surface and the stepped side portions are substantially parallel to the flat surface of the central portion.

16. The dispensing container according to claim 12, wherein the central portion is recessed relative to the stepped side portions of the profiled support surface of the dispenser, forming a substantially U-shaped cross-section of the support.

17. The dispensing container according to claim 16, further comprising inner side surfaces extending between the respective stepped side portions and the central portion, wherein the inner side surfaces are substantially parallel to each other.

18. The dispensing container according to claim 16, further comprising inner side surfaces extending between the respective stepped side portions and the central portion, wherein the inner side surfaces are closer to each other toward the stepped side portions than toward the central portion.

19. The dispensing container according to claim 16, comprising a pair of walls projecting on both sides of the central portion, the pair of walls having end surfaces that comprise the stepped side portions, wherein the pair of walls comprises inner side surfaces extending between the end surfaces and the central portion, and outer side surfaces opposite the inner side surfaces, respectively, wherein the recessed central portion comprises a flat surface, and wherein the outer side surfaces are oriented substantially perpendicularly relative to the flat surface of the central portion.

20. The dispensing container according to claim 12, wherein the stepped side portions are recessed relative to the central portion of the profiled support surface of the support of the dispenser, forming a substantially T-shaped cross-section of the support.

* * * * *